United States Patent [19]

Mizutani et al.

[11] 4,073,598

[45] Feb. 14, 1978

[54] CEILING FAN

[75] Inventors: Taketomo Mizutani, Aza-Taka; Takaharu Yasunori, Himeji; Kazuyoshi Yoshimi, Kasai, all of Japan

[73] Assignee: Sanyo Electric Co., Ltd., Moriguchi, Japan

[21] Appl. No.: 676,888

[22] Filed: Apr. 14, 1976

[30] Foreign Application Priority Data

| | | |
|---|---|---|
| Apr. 17, 1975 | Japan | 50-52743 |
| Aug. 8, 1975 | Japan | 50-111538 |
| Aug. 22, 1975 | Japan | 50-116300 |
| Aug. 29, 1975 | Japan | 50-119407 |

[51] Int. Cl.[2] ..... F04D 29/64

[52] U.S. Cl. ..... 416/5; 416/93 R; 416/170 R

[58] Field of Search ..... 416/5, 93, 170, 174, 416/501

[56] References Cited

U.S. PATENT DOCUMENTS

| | | | |
|---|---|---|---|
| 564,455 | 7/1896 | Scott | 416/5 |
| 585,250 | 6/1897 | Bennett | 416/5 |
| 623,801 | 4/1899 | Melzer | 416/5 |
| 2,079,942 | 5/1937 | LeVelle | 416/5 X |
| 2,119,398 | 5/1938 | Morse | 416/5 |
| 2,581,185 | 1/1952 | Gordon | 416/5 |

FOREIGN PATENT DOCUMENTS

| | | | |
|---|---|---|---|
| 525,859 | 5/1955 | Italy | 416/5 |
| 478,417 | 1/1938 | United Kingdom | 416/93 |
| 608,569 | 9/1948 | United Kingdom | 416/5 |

*Primary Examiner*—Everette A. Powell, Jr.
*Attorney, Agent, or Firm*—Darby & Darby

[57] ABSTRACT

A ceiling fan comprises a cover provided with a rotor and wings, a stator, a fixed shaft attached to the stator and a member mounted on the fixed shaft and functioning as a protection member and/or fitting member. Thereby the fan is under protection, and parts of the fan and other equipments are easily fitted thereto.

8 Claims, 19 Drawing Figures

30
34
37
36
32
29
45
31
21
40
43
43
20
17
13
15
14
19
5
2
8
7
17
12
11
6
9
18
103
105
106
3
4
108
26
110
109
107
25
26
23
24
100

34
30
37
36
32
45
29
31
40
21
101
43
43
20
17
13
15
19
8
17
14
18
5
2
7
4
6
12
11
102
3
104
26
24
25
107
26
106
105

34
30
44
37
45
36
32
150
29
31
43
21
40
14
20
13
22
17
152
22
15
17
8
151
152
7
19
6
11
9
12
24
10
2
18
156
46
25
158
161
159
154
155
156
26
5
3
4
153

34
30
44
36
37
45
31
32
29
40
200
21
43
20
43
17
14
13
151
19
12
11
8
15
17
18
7
5
2
6
9
3
25
26
4
26
156
202
205
24
203
206
201
207
210
211
208
204
209
153

CEILING FAN

BACKGROUND OF THE INVENTION

The present invention relates to a ceiling fan, particularly to a suspension type electric ceiling fan using a motor in which a stator is disposed inside with a rotor outside.

Generally, this kind of conventional ceiling fan is large in size, presenting many difficulties in the processes of manufacturing, assembling, transporting and fitting. That is, in manufacturing, assembling and transporting a ceiling fan, components, e.g. a coil of a motor and the like, are apt to be damaged. Further, in the fitting operation, components, e.g. a plastic or metal cover for the ceiling fan and the like, are apt to be depressed or damaged when placed on the floor. Furthermore, a ceiling fan, which is generally fitted to the substantially central portion of a ceiling, will compete for a desirable fitting position with equipment having another function, e.g. a ceiling lamp. Further, in the conventional ceiling fan, means for rotating the fan and/or controlling the rotation speed, e.g. a switch, a control circuit and the like, are set up in positions far away from the fan, and therefore the total cost of the fan with its attachments necessarily becomes high. On the other hand, in the conventional fan, when a rotor rotatably supported by one or more bearings which are press fitted into and/or press-fittedly mounted on another member is displaced due to the reduction of the said press fit effect, the result is the generation of heat, vibration or noises in the fan and damage to the fan itself through the contact of a stator with the rotor in operation.

Therefore, an object of the present invention is to provide an improved and effective ceiling fan by eliminating the abovementioned disadvantages.

SUMMARY OF THE INVENTION

According to the present invention, there is provided a ceiling fan comprising a cover having a rotor and wings, a stator, a fixed shaft provided on the stator, and a member for protecting the fan and/or fitting an electric part in which the member is mounted on the fixed shaft.

Therefore, a ceiling fan according to the present invention permits extremely easy manufacturing, assembling, transporting and fitting thereof while reducing damages to the components, fitting the fan at a desired position without competing with another equipment, e.g. a ceiling lamp, and reduction of total cost of the fan with attachments. Further, a ceiling fan according to the present invention can prevent hindrance in operation even if the effect of press fit and/or press fitted mount is reduced, thereby curtailing the generation of heat, vibration and noises, as well as extremely reducing damage of the fan itself.

BRIEF DESCRIPTION OF THE DRAWINGS

These and other objects and advantages of the present invention will become more apparent from the following description given with reference to the appended drawings, in which.

DESCRIPTION OF A PREFERRED EMBODIMENT

Figure 1:
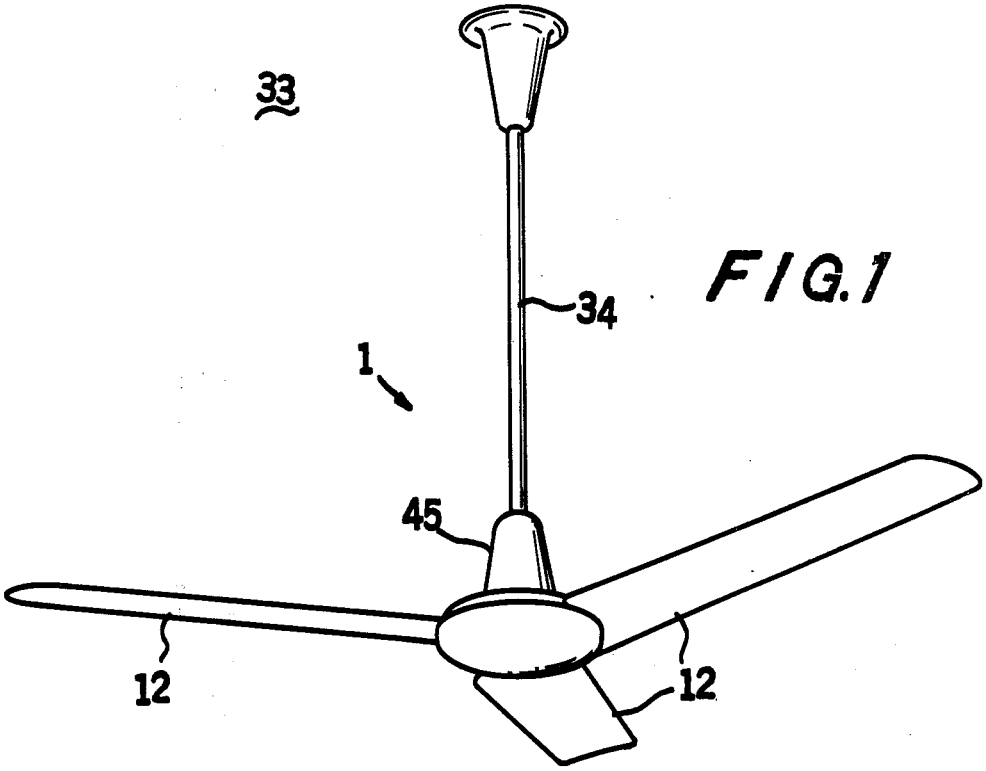
FIG. 1 is a perspective view of a ceiling fan according to the present invention.
Figure 3:
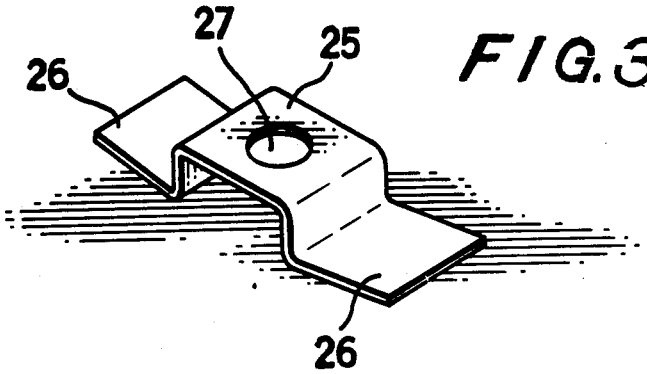
FIG. 3 is a perspective view of a member of a ceiling fan according to the present invention.
Figure 2:
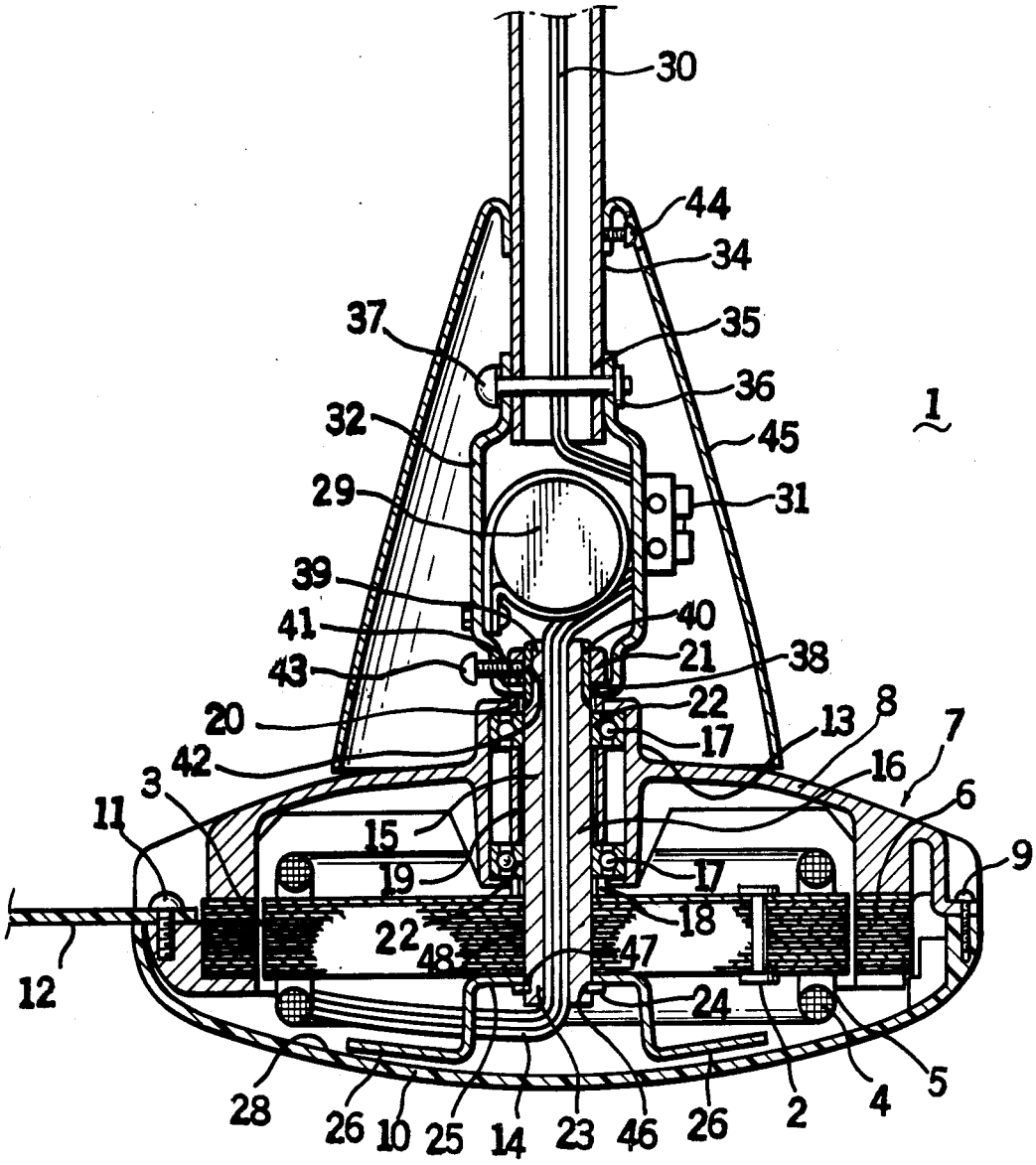
FIG. 2 is a vertical sectional view of the ceiling fan in FIG. 1.

Referring to the drawings, wherein the same numerals indicates the same element in the several drawings, FIGS. 1 to 3, show a ceiling fan 1 adapted to be suspended from the ceiling. An overhung and outer rotor type motor 7 includes a conventional stator 5 disposed inside and including laminated iron plates 3 connected by a cylindrical pin 2, a coil 4 formed of electric conductive material and a rotor 6 disposed outside. The ceiling fan 1 is further provided with an upper cover 8 for the motor 7. The upper cover 8 is illustratively formed into a circular shape from plastic or metal material, and fitted onto the rotor 6 or molded with the rotor 6 embedded therein. The upper cover 8 is provided with a lower cover 10 formed from plastic or metal material and connected thereto by means of screws 9, and further with a plurality of radial wings 12 to circulate air mounted thereto by means of screws 11.

The upper cover 8 is further provided at the center thereof with an integrally molded cylindrical portion 13. The cylindrical portion 13 is rotatably supported by means of bearings 17 e.g. ball bearings at the upper portion 16 of a cylindrically shaped vertical fixed shaft 15 press fitted through the center of the stator 5 so as to extend above the middle of the stator 5. Through the fixed shaft 15 passes a lead wire 14 comprising electric conductive material and the like.

The upper one of the bearings 17 is press fitted into the cylindrical portion 13 of the upper cover 8 while the lower bearing 17 is, after a collar 18 is loosely mounted on the stator 5, press fitted onto the vertical fixed shaft 15. The fitting operation comprises inserting a collar 19 into the cylindrical portion 13 into which the upper bearing 17 is preliminarily press fitted, then passing the vertical fixed shaft 15 through the cylindrical portion 13, further mounting another collar 20 and threadedly engaging the fixed shaft 15 with a nut 21. The three collars 18, 19 and 20 have a diameter equal to the diameter of the inner ring 22 of the bearings 17, and each of the upper and lower bearings is interposed between the collars respectively to completely fix the inner rings 22 of the bearings.

A member 25 formed from metal or plastic material and having a protection effect is inserted between a ring 24 as a stopper e.g. a conventional E ring mounted around the lower portion 23 of the vertical fixed shaft 15 and the stator 5. The protection member 25 is provided with bent portions 26 on both sides and a circular opening 27 at the center, and located adjacent to the inner surface 28 of the lower cover 10.

A connecting member 32, an operation condenser 29 for phase advancing of the motor 7, a lead wire 30 formed of electric conductive material, a connection terminal 31 for the lead wire 14 are pivotally mounted on the lower end 35 of a hollow cylindrical suspending rod 34 suspended from the ceiling 33, by means of a pin 37 stopped by a conventional E ring 36. The upper end 39 of the vertical fixed shaft 15 is inserted through a through hole 38 provided in the lower surface of the connecting member 32, and the shaft 15 is stopped by threadedly engaging a nut 21 provided at the lower portion 41 of the connecting member 32 with a threaded portion 40 provided at the upper end 39 of the fixed shaft 15. A screw 43 is threadedly engaged through the connecting member 32 with the nut 21 in the lateral direction so that the head portion of the screw urges the side 42 of the vertical fixed shaft 15, preventing the nut 21 from being loosened during the operation of the fan.

Further, above the upper cover 8 a trapezoidally sectional cover 45 which may have, if desired, a decorated outer surface may be fixedly fitted to the suspending rod 34 by means of a fixing member 44, so that the terminal 31, the condenser 29 and the like are protected from dust or the like.

Figure 4:
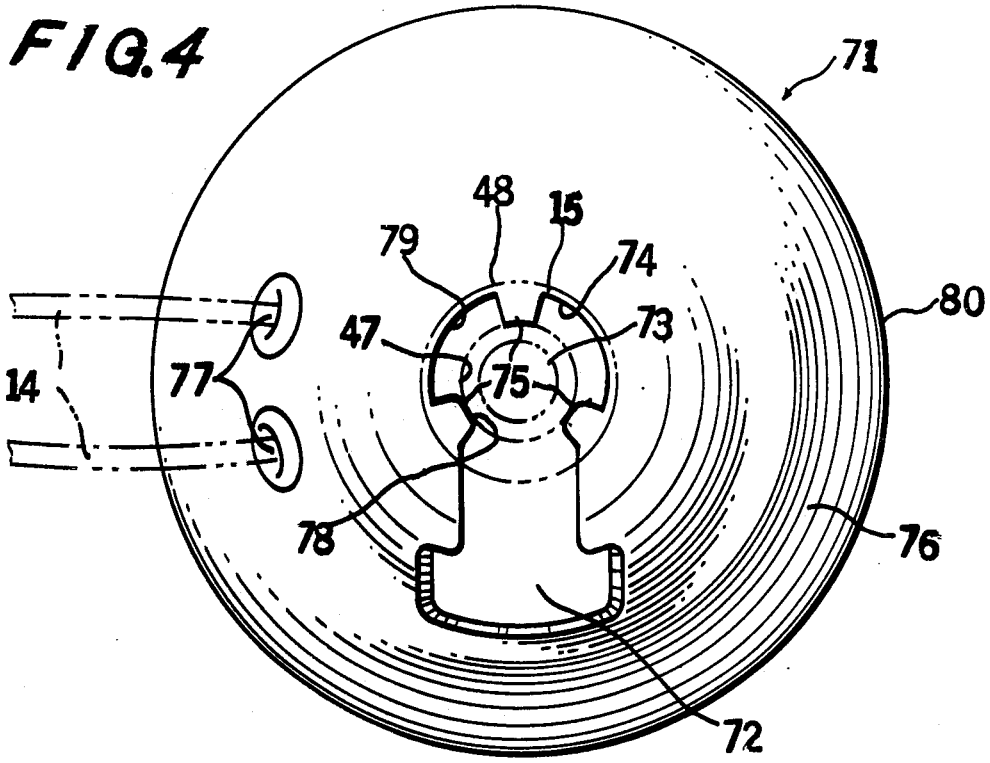
FIG. 4 is a plan view of modifications of the member in FIG. 3.
Figure 5:
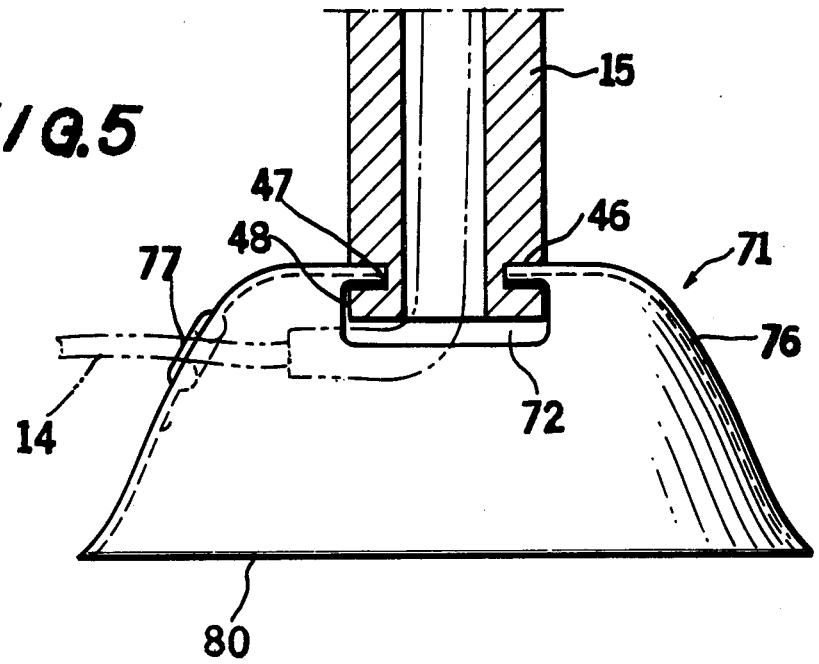
FIG. 5 is a side view of the member in FIG. 4.

Referring to FIGS. 4 and 5, there is shown an alternative embodiment 71 of the protection member 25 in a plan view in FIG. 4 while in a side view in FIG. 5. The member 71, formed from metal or plastic material, may be cup-shaped and coaxial with the vertical fixed shaft 15. At its substantial center the member 71 includes a through hole 73 having a cutaway portion 72. At an edge 74 around the through hole 73, there are further provided a plurality of projections 75 functioning as a conventional E ring together with the cutaway portion 72, while the skirting portion 76 of the cup-shaped member 71 is provided with at least one hole 77 for passing the lead wire 14 therethrough. The diameter of an imaginary circle defined by the top portions 78 of the projections 75 is selected to be substantially equal to that of the bottom peripheral face 47 of a groove 46 around the lower end 23 of the fixed shaft 15. The diameter of an imaginary circle defined by the peripheral edge portion 79 except along the projections 75 is smaller than the outer diameter of the vertical fixed shaft 15, while the dimension and shape of the cutaway portion 72 is selected depending upon the diameter of the bottom peripheral face 47 and the length of the vertical fixed shaft portion below the groove 46. Consequently, the cup-shaped member 71 is coaxially mounted on the fixed shaft 15 through the fitting of the same into the groove 46 of the latter, the resiliency of the member 71 preventing the disengagement thereof. Further, the cup-shaped member 71 is so adapted that the lower portion 80 thereof is disposed adjacent to the inner surface 28 of the lower cover 10 when mounted on the vertical fixed shaft 15.

Alternatively, the cup-shaped member 71 may be mounted on the fixed shaft 15 by providing a threaded opening substantially at the center of the cup-shaped member 71 to engage a threaded portion on the peripheral surface 48 of the lower end 23 of the fixed shaft 15.

Generally, a ceiling fan is of a large size, and therefore the lower cover 10 is apt to be depressed or broken when the fan is put on the floor in fitting operation. This problem is alleviated by the present invention. According to the present invention, the member 25 is provided beneath the lower surface of the stator 5 with the bent portions 26 of the member 25 adjacent to the inner surface of the lower cover 10 as abovementioned, and the lower cover 10 may be put on the floor and depressed. A further depression is prevented, however, by the bent portions 26, and when removed from the floor, the lower cover 10 returns to its original state due to its resiliency. Accordingly, the lower cover 10 is neither injured in appearance nor broken. Further, when the stator 5 is put on a bench in assembling operation, the bent portion 26 of the member 25 serve as legs to keep the stator 5 up away from the bench, whereby the coil 4 of the motor 7 is hardly damaged. Practically speaking, this advantage is of great importance to manufacturers.

Figure 6:
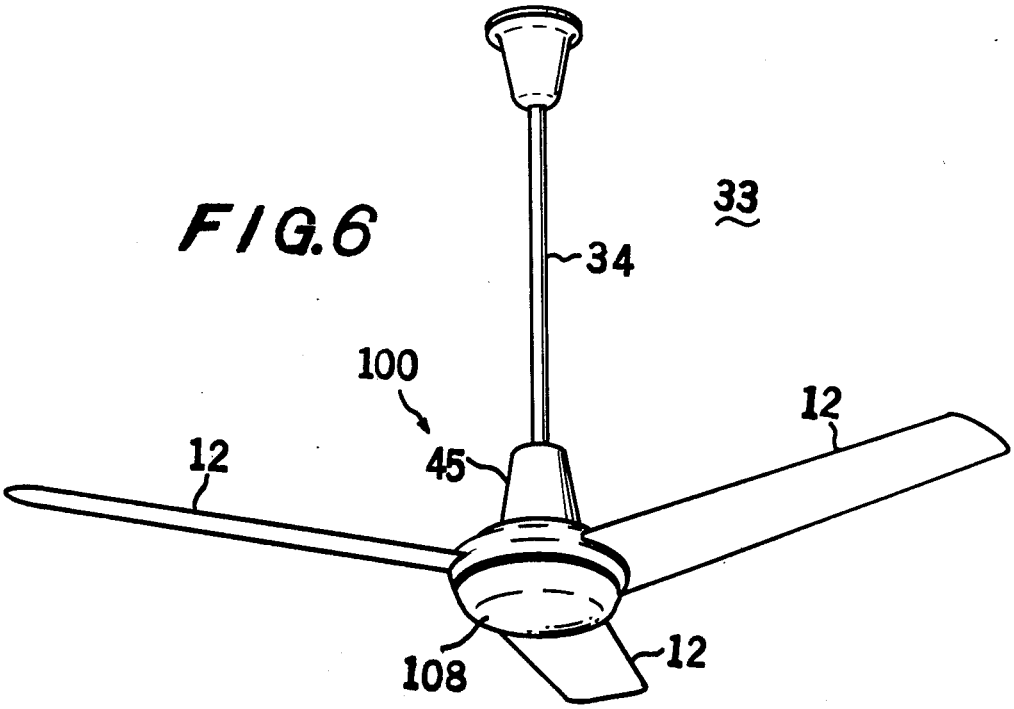
FIG. 6 is a perspective view of another embodiment of a ceiling fan according to the present invention.
Figure 9:
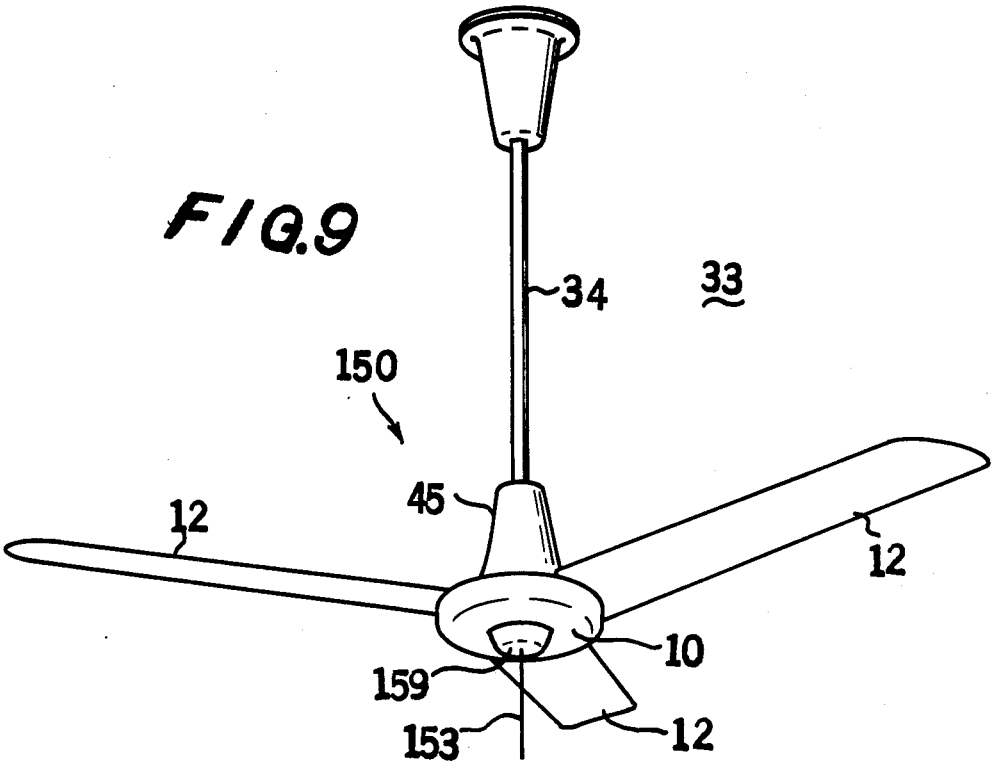
FIG. 9 is a perspective view of a further embodiment of a ceiling fan according to the present invention.

Other embodiments of the present invention will be now described with reference to FIGS. 6 to 8. A ceiling fan 100 or 101 is provided with the outer rotor type motor 7 including a stator 5 disposed inside and a rotor 6 disposed outside. An upper cover 8 for the motor 7 is provided in which the rotor 6 may be embedded during molding. On the cover 8, a case 103 or light permeable cover 104 having a decorated surface is mounted by means of the screw 9 or a screw 102. A plurality of radial wings 12 are mounted by means of screws 11.

A member 25 functions also as a fitting member and fixedly interposed between the E ring 24 mounted on the lower end 23 of the fixed shaft 15 and the stator 5. A reflecting plate 105 of a lamp 106 is mounted through downwardly bent portions 26 on both sides to the member 25. The lower surface of the reflecting plate 105 is provided with an annular fluorescent lamp 106, a stabilizer 107 and others.

The ceiling fan 100 or 101 includes the same member as described with respect to the first embodiment, and the detail is omitted here.

Figure 7:
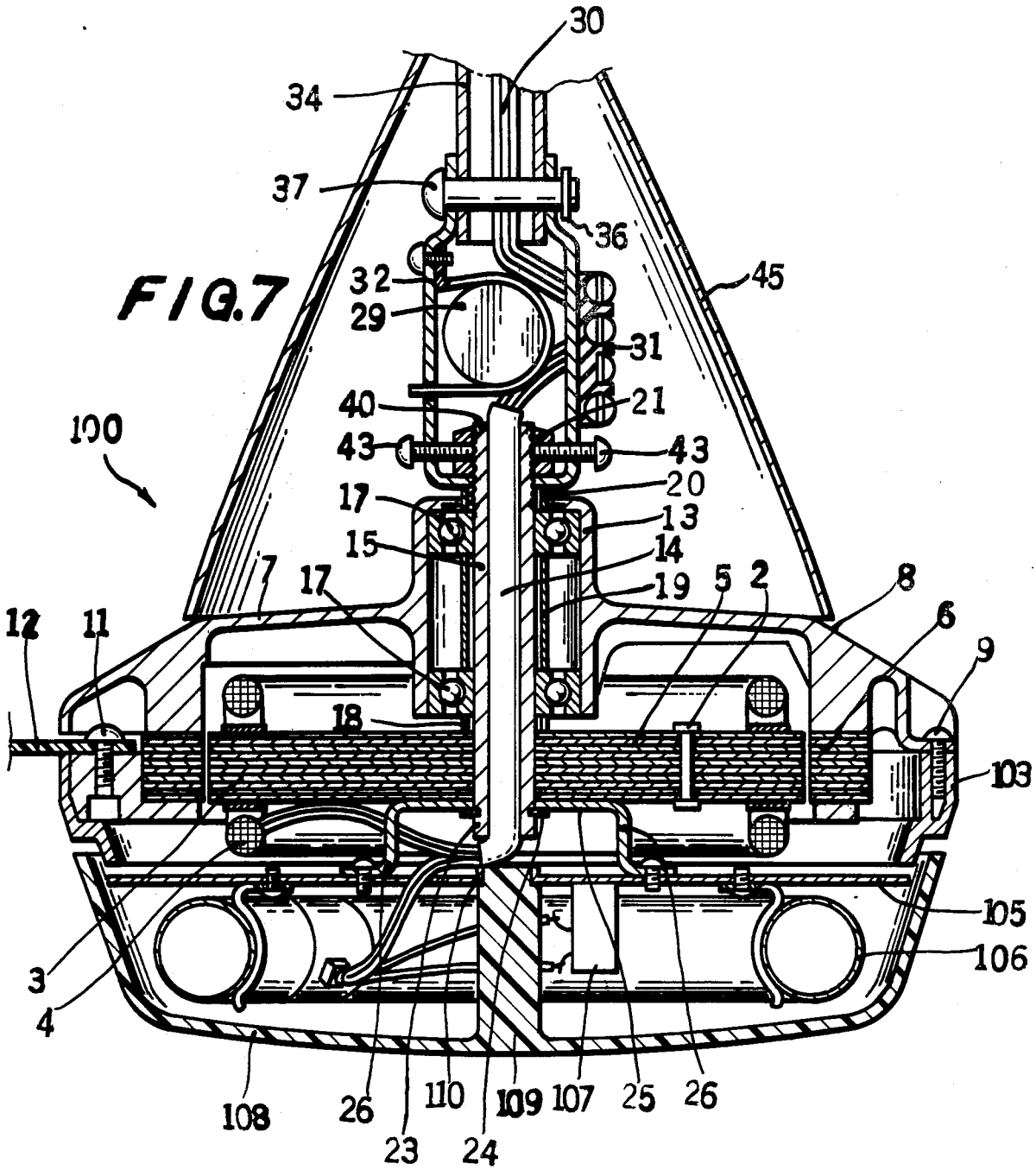
FIG. 7 is a vertical sectional view of the ceiling fan in FIG. 6.

As shown in FIG. 7, in the ceiling fan 100, a light permeable cover 108 enclosing the fluorescent lamp 106 is fixed by engaging a shaft 109 extending upwardly from the center of the cover with a threaded portion 110 provided at the center of the reflecting plate 105.

Figure 8:
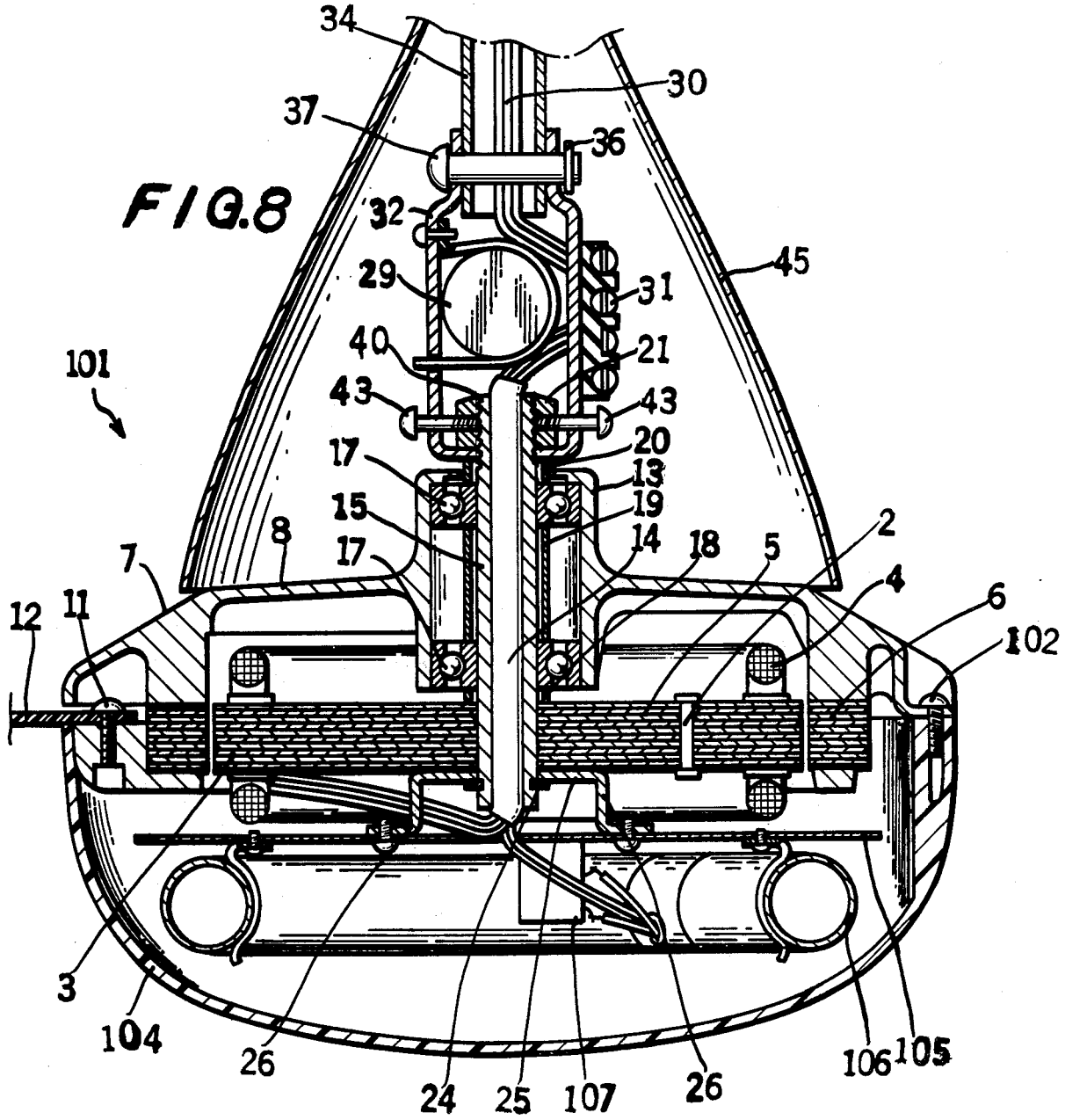
FIG. 8 is a vertical sectional view of a modification of the ceiling fan in FIG. 6.
Figure 10:
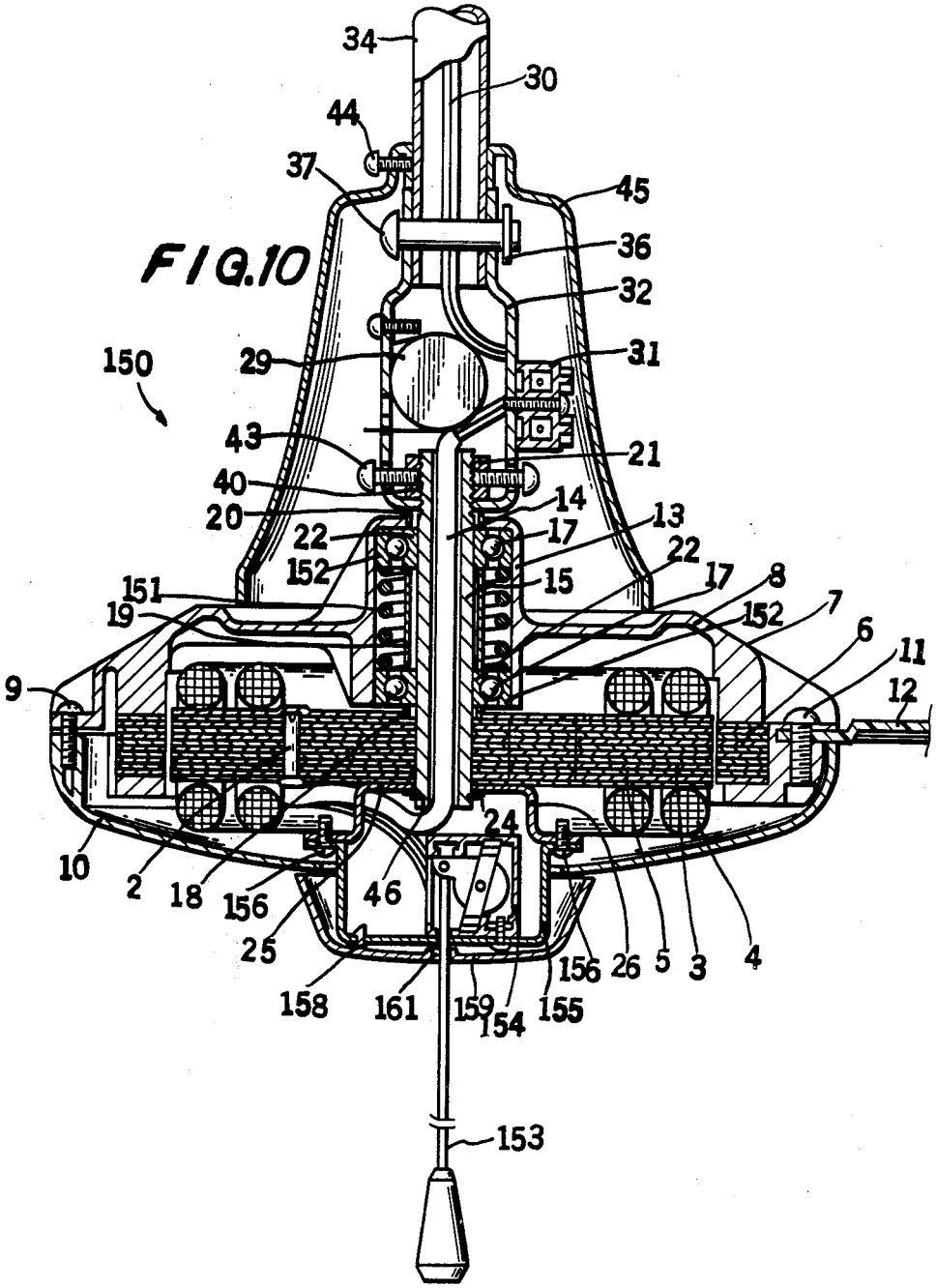
FIG. 10 is a vertical sectional view of the ceiling fan in FIG. 9.
Figure 11:
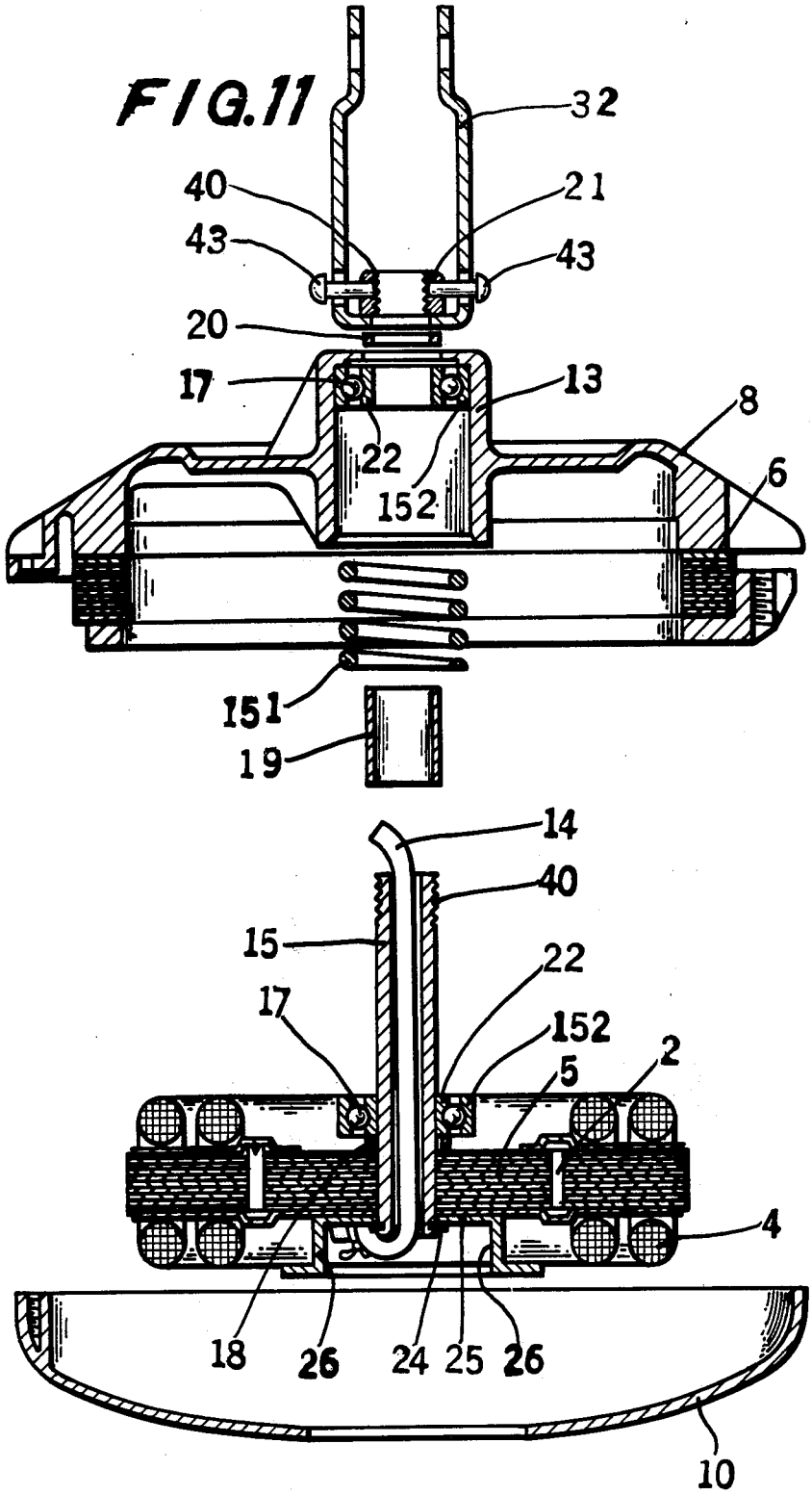
FIG. 11 is a vertical sectional view of the ceiling fan in FIG. 10 in which parts thereof are shown in disassemled condition.
Figure 12:
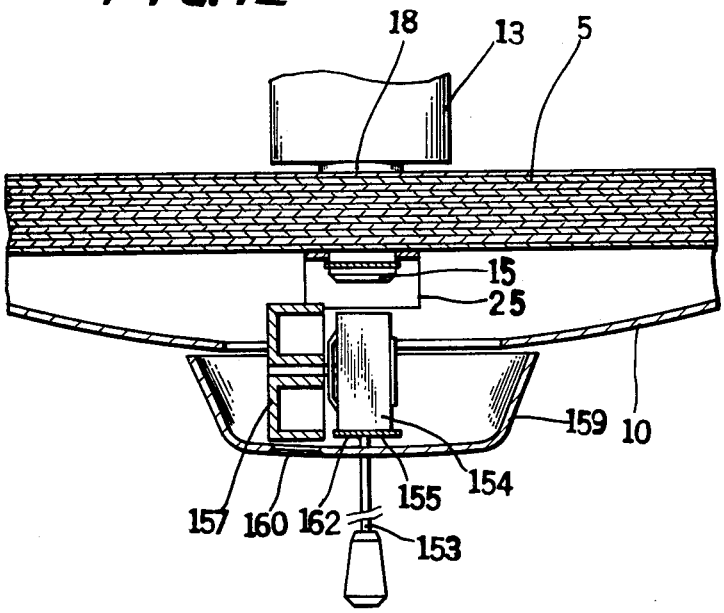
FIG. 12 is a vertical sectional view of a pull switch fitting portion of the ceiling fan in FIG. 10.

On the other hand, as shown in FIG. 8, in the ceiling fan 101, the light permeable cover 104 is fitted to the upper cover 8 for the motor 7 by means of the screws 102.

Consequently, the ceiling fans 100 and 101 can be applied for the additional purpose of lighting. Advantageously the lighting equipment may be fitted by means of the member 25 mounted on the lower portion of the vertical fixed shaft 15 passing through the stator 5 of the motor 7. In this arrangement, the fitting is easier than in case of using a motor 7 in which a rotor 6 is disposed inside. A reflecting plate 105 interposed between the lighting equipment and the motor 7 prevents heat transmission therebetween. Further, similar to the abovementioned first embodiment, when the stator 5 is put on a bench in assembling operation, the bent portions 26 of the member 25 serve as legs to keep the stator 5 up away from the bench, whereby the coil 4 of the motor 7 is insulated from damage.

Another embodiment of the present invention will be now described with reference to FIGS. 9 to 12. In a ceiling fan 150, the upper one 17 of two bearings is press fitted into the central cylindrical portion 13 of the upper cover 8, while the lower bearing 17, after mounting the collar 18 on the stator 5, is press mounted on the vertical fixed shaft 15. After inserting a coil spring 151 and the collar 19 into the cylindrical portion 13, the vertical fixed shaft 15 is inserted through the cylindrical portion 13. Next, another collar 20 is installed, which is threadedly engaged with the nut 21. These three collars have a diameter equal to the diameter of the bearing and each of the bearings is interposed between the collars so that the inner rings 22 thereof are perfectly fixed.

The spring 151 is interposed between the outer rings 152 of the bearings 17 and in resilient contact with the latter. Though the inner ring 22 of the lower bearing 17 is press fitted on the vertical fixed shaft 15, the outer ring 152 is only put into the central cylindrical portion 13. Therefore, a slip occurs between the outer ring 152 and the central cylindrical portion 13 to cause wear thereof, which are apt to result in vibration and noises. However, in this embodiment, since the coil spring 151 is resiliently interposed between the outer rings 152 of the upper bearing 17 press fitted into the cylindrical portion 13 and of the lower bearing 17 as abovementioned, the outer ring 152 of the lower bearing 17 necessarily rotates together with the cylindrical portion 13, thereby preventing slip therebetween. Further, the upper bearing 17 is press fitted into the cylindrical portion 13 and only the vertical fixed shaft 15 passes through its said inner ring 22, and so the said inner ring is apt to rotate together with the outer ring to cause the slip relative to the stationary vertical fixed shaft 15. In this embodiment, however, the said inner ring 22 is, with the interposition of the collar 19, in press contact with the inner ring 22 of the lower ring 17 and thus prevented from rotating together with the outer ring 152, thereby causing no slip.

Further, the ceiling fan 150 is provided with a member 25 of the kind as abovementioned and further adapted to serve for fitting a pull switch 154, between the E ring 24 mounted on the lower end of the vertical fixed shaft 15 and the lower surface of the stator 5. Straddling the bent portions 26 of the member 25, a fitting member 155 for the pull switch 154 is fixed by means of a screw 156. The pull switch 154 is mounted on the fitting member 155. The pull switch 154 is adapted to switch a transmission tap of the motor 7 every time a pull string 153 is pulled, for which the arrangement and operation of the electric circuit will be described later. Therefore, a cylindrical speed indicator 157 is adapted to rotate stepwise every time the tap is switched. A switch cover 159 for the switch 154 is mounted to the lower portion of the fitting member 155 by fitting a projection 158 into the fitting member 155. The switch cover 159 is provided with an opening 160 through which speed indicating numerals written on said speed indicator can be seen and a hole 161 for passing the pull string 153 therethrough. The switch cover 159 may be fitted directly to the lower surface 162 of the switch 154.

As abovementioned, in the ceiling fan 150 according to the present invention, the motor cover 8 is supported by the fixed shaft 15 through the upper bearing 17 preliminarily press fitted into the central cylindrical portion 13 of the motor cover 8 and the lower bearing 17 press mounted on the vertical fixed shaft 15. The collar is interposed between the outer or inner rings of the upper and lower bearings 17 with the coil spring 151 between the inner or outer rings. Consequently, the two bearings are kept in a predeterminedly spaced condition from each other and thus prevented from moving in the vertical direction. Further, since the outer rings 152 as well as the inner rings 22 of the upper and lower bearings are connected together, no slip occurs between the inner ring 22 of the upper bearing and the vertical fixed shaft 15 or between the outer ring 152 of the lower bearing and the central cylindrical portion 13, thus completely eliminating possible vibration, noises and the contact between the stator 5 and the rotor 6 of the motor 7 due to the wear of the parts caused by slip.

Further, the ceiling fan 150 is provided with the protective member 25, which besides serving for fitting the pull switch 154, permits the reduction of the damage to the coil 4 in the fitting operation since when the stator 5 is put on a bench in assembling operation, the bent portions 26 of the member 25 serve as legs to keep the stator 5 up away from the bench.

Further, in the ceiling fan 150 the pull switch 154 for speed change is mounted to the lower portion of the stator 5, a coil for speed change can be installed within the motor 7 though in a ceiling fan, thereby lowering the cost in comparison with a conventional motor to which a separate choke coil is connected. Furthermore, since the pull switch 154 is mounted beneath the stator, the speed indicator fitted to the switch can be conveniently seen from below. The switch cover 159 is mounted to the lower surface of the pull switch 154 or the member for fitting the same, so that the speed indicator 157 can be located substantially in an accurate face to face condition with the opening 160 provided in the switch cover, and thereby facilitated to be looked at.

Figure 13:
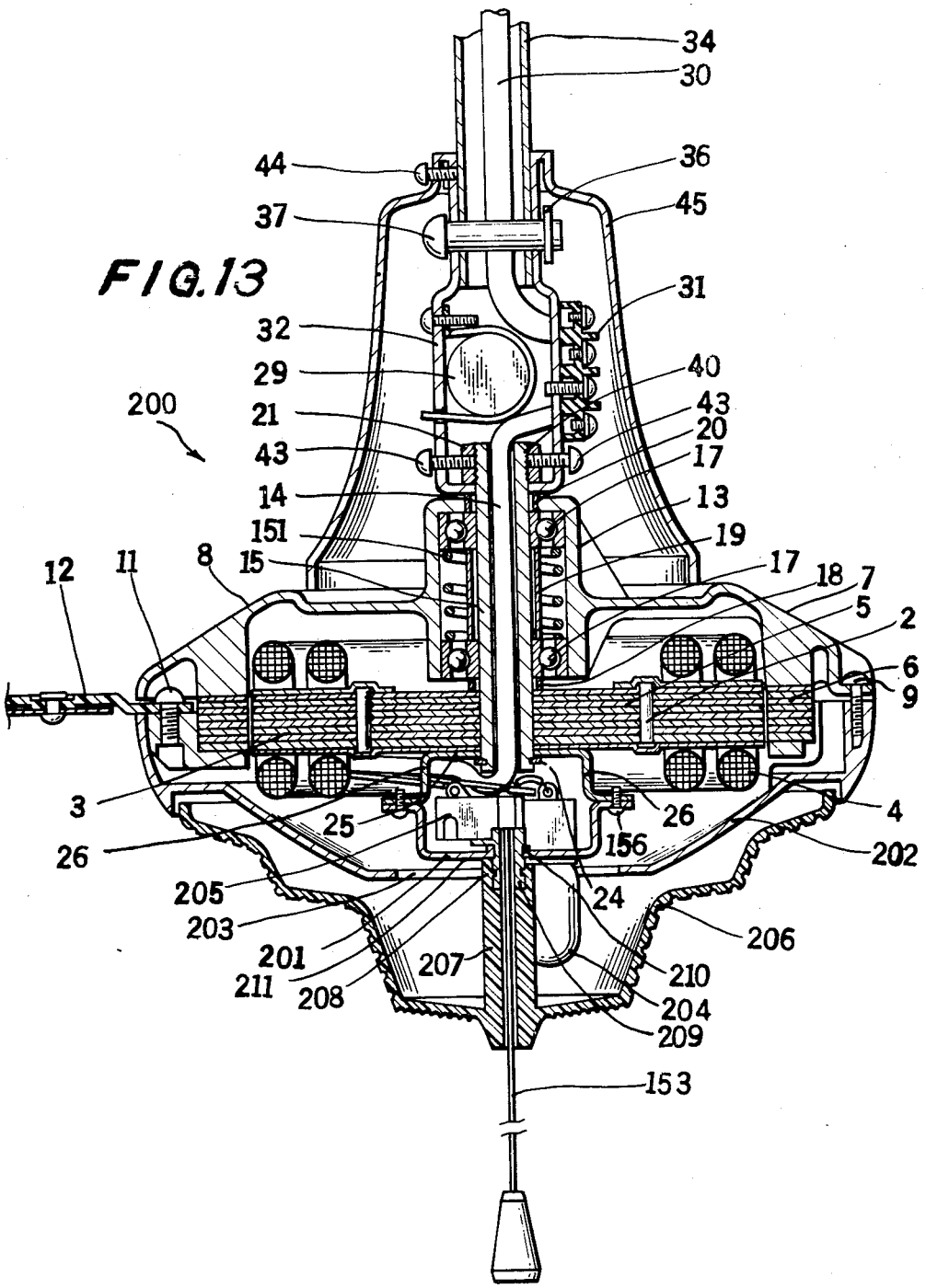
FIG. 13 is a vertical sectional view of a further embodiment of a ceiling fan according to the present invention.

A further embodiment of a ceiling fan according to the present invention is shown in FIG. 13. In a ceiling fan 200, the member 25 as a connecting member is interposed between an E ring 24 mounted to the lower end 23 of a vertical fixed shaft 15 and the lower surface of a stator 5. To downwardly bent portions 26 on both sides of the member 25, a member 201 for fitting electric parts thereon is fixed by means of screws 156 so that the member 201 faces an opening 203 provided in the center of a motor cover 202. And to the member 201, there are mounted a lamp 204 connected to the lead wire 14 and a pull switch 205 for turning on and off the lamp 204 through the operation of a pull string 153.

In the light permeable cover 206 for the lamp 204, a cylindrical metal member 209 is integrally embedded in the upper end portion 208 of an upwardly protruding central shaft 207 in the time of molding. The cover 206 is mounted coaxially with the suspending rod 34 by threadedly engaging the threaded portion 210 provided over the outer surface of the metal member 209 with the electric part fitting member 201. The central shaft 207 of the light permeable cover 206 has a cylindrical shape, through which the pull string 153 of the switch 205 extends. Consequently, the string 153 is prevented from touching the movable part of the motor 7. Further, the whole of the ceiling fan 200 does not swing when the string 153 is strongly pulled, because the central shaft 207 is coaxial with the suspending rod 34.

Figure 14:
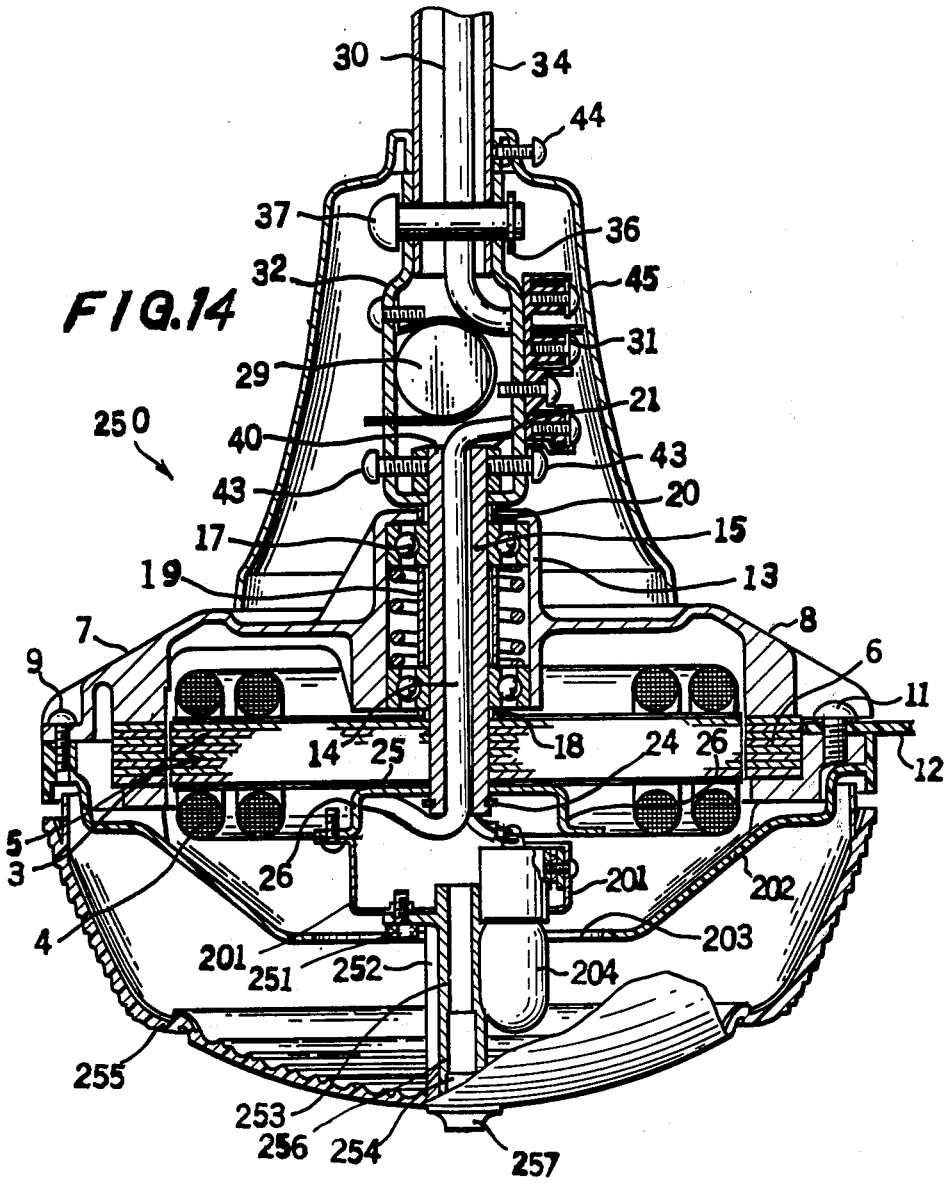
FIG. 14 is a vertical sectional view of a modification of the ceiling fan in FIG. 13.

A ceiling fan 250 in FIG. 14 is a modification of the fan 200, and is provided on its fitting member 201 with the lamp 204 connected to the lead wire 14, in which, however, the pull switch for turning on and off the lamp 204 is omitted.

Further, the ceiling fan 250 includes a cylindrical supporting shaft 253 formed from metal or plastic material. This shaft 253 is fixed to the lower surface of the fitting member 201 by means of a screw 251 and is coaxial with the vertical fixed shaft 15. Shaft 253 is provided on the outer surface thereof with a plurality of integrally formed, longitudinally positioned, and radially spaced elongated ribs 252 for reinforcement. The supporting shaft 253 is provided at its lower end portion with an inner threaded portion 254, and the threaded lower end portion is inserted into an upwardly extending cylindrical through hole 256 provided at the center of a light permeable cover 255. A decorated screw 257 is threadedly engaged through the light permeable cover with the threaded portion 254. Accordingly, each of the reinforcing ribs 252 is adapted to contact the upper surface of the cylindrical through hole 256.

In case of this ceiling fan 250, the operation of turning on and off the lamp 204 and/or the rotation speed of the motor 7 is controlled by a controlled circuit remotely positioned.

Figure 15:
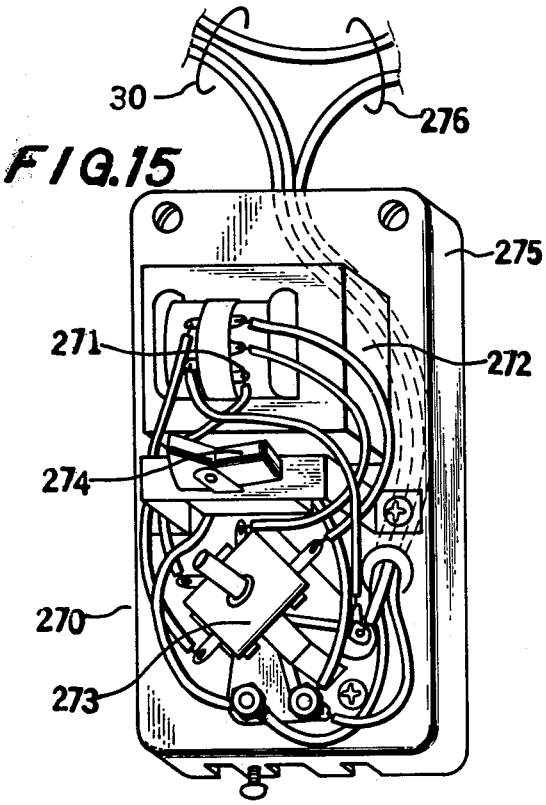
FIG. 15 is a perspective view of a controlling device for controlling the turn on and off of a lamp of a ceiling fan according to the present invention and the rotation speed of a motor of the fan.
Figure 16:
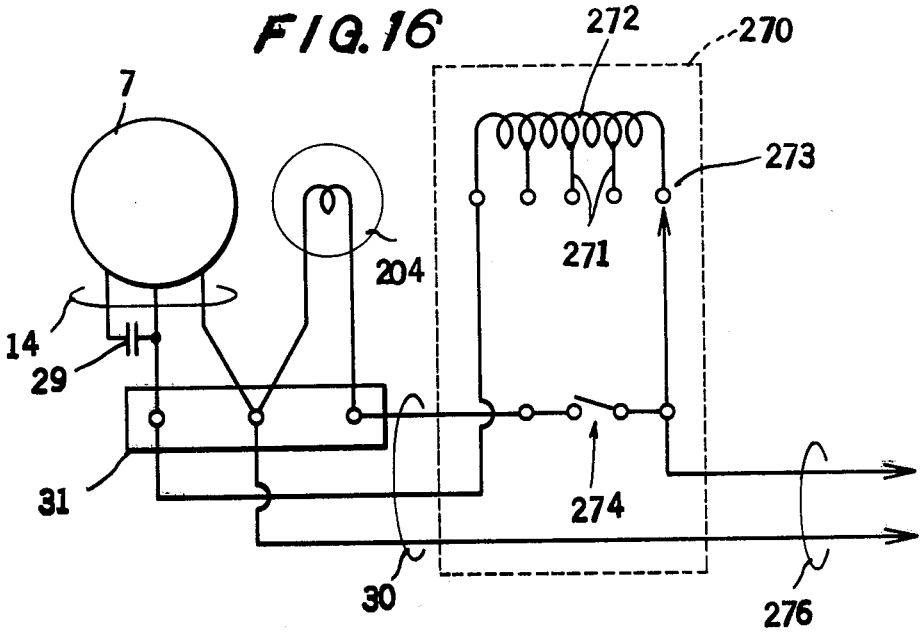
FIG. 16 is an electric circuit diagram for the controlling device in FIG. 15.

Referring to FIGS. 15 and 16, there is shown an example of controlling device for turning the lamp 204 on and off of and for controlling the rotation speed of the motor 7.

In FIGS. 15 and 16, a controlling device 270 comprises a choke coil 272 having at least one intermediate tap 271 and adapted to increase or reduce the rotation speed of the motor 7, a speed controlling switch 273 (e.g. a rotary switch having a plurality of contacts for selecting the intermediate taps and thereby the rotation speed of the motor 7), a switch 274 (e.g. a snap switch for turning on and off the lamp 204), a support 275, and a cover (not shown). When an alternative current is supplied through a lead wire 276, the motor 7 rotates at a predetermined speed corresponding to the position of the speed controlling switch 273 set. And when a lamp switch 274 is closed, the lamp 204 is turned on.

Accordingly, a part or the whole of the controlling device 270 is applicable to a ceiling fan according to the present invention.

Figure 17:
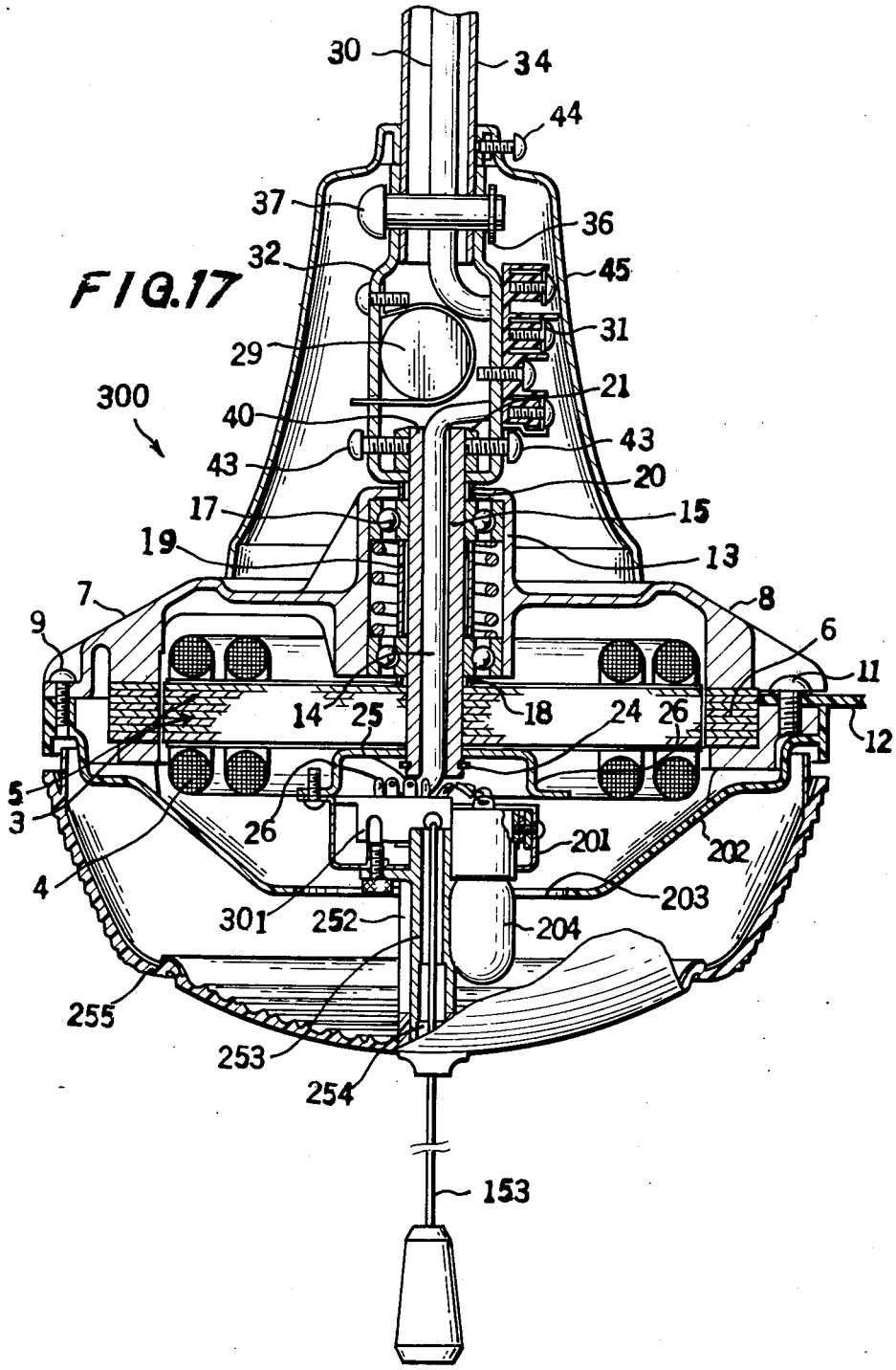
FIG. 17 is a vertical sectional view of a further modification of the ceiling fan in FIG. 13.

A ceiling fan 300 in FIG. 17 is a modification of the fan 250, and further provided on the fitting member 201 with a controlling device 301 for turning on and off the lamp 204 and for controlling the rotation speed of the motor 7, each by operating the pull string 153. Namely, in the ceiling fan 300, by operating the pull string 153, the lamp 204 is turned on and off and the rotation speed of the motor is controlled.

Figure 19:
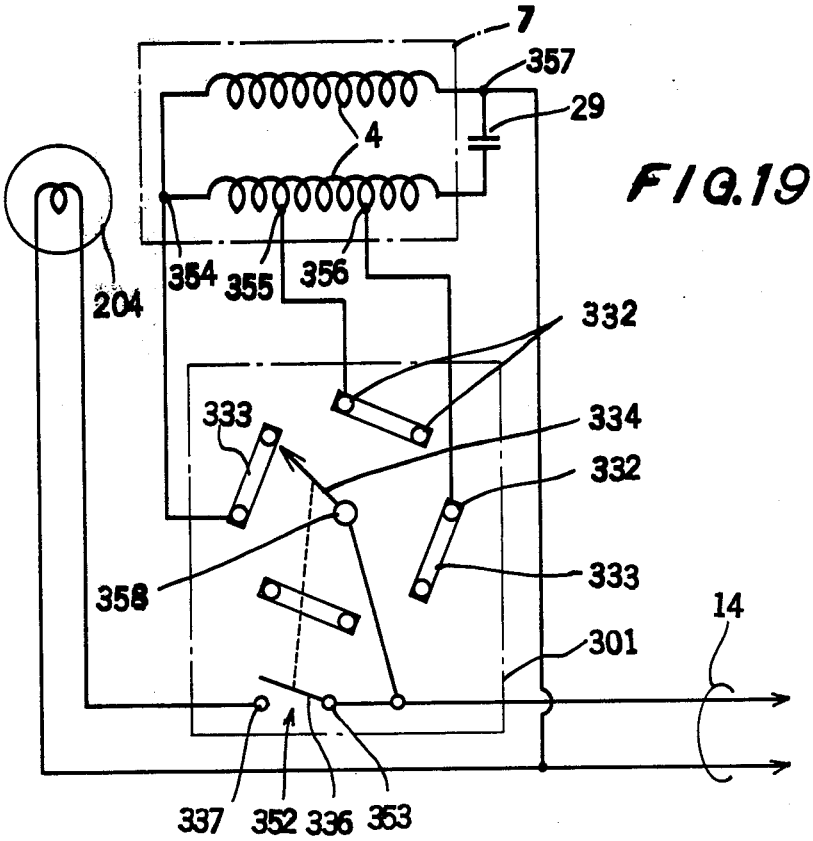
FIG. 19 is an electric circuit diagram for the controlling device in FIG. 18.
Figure 18:
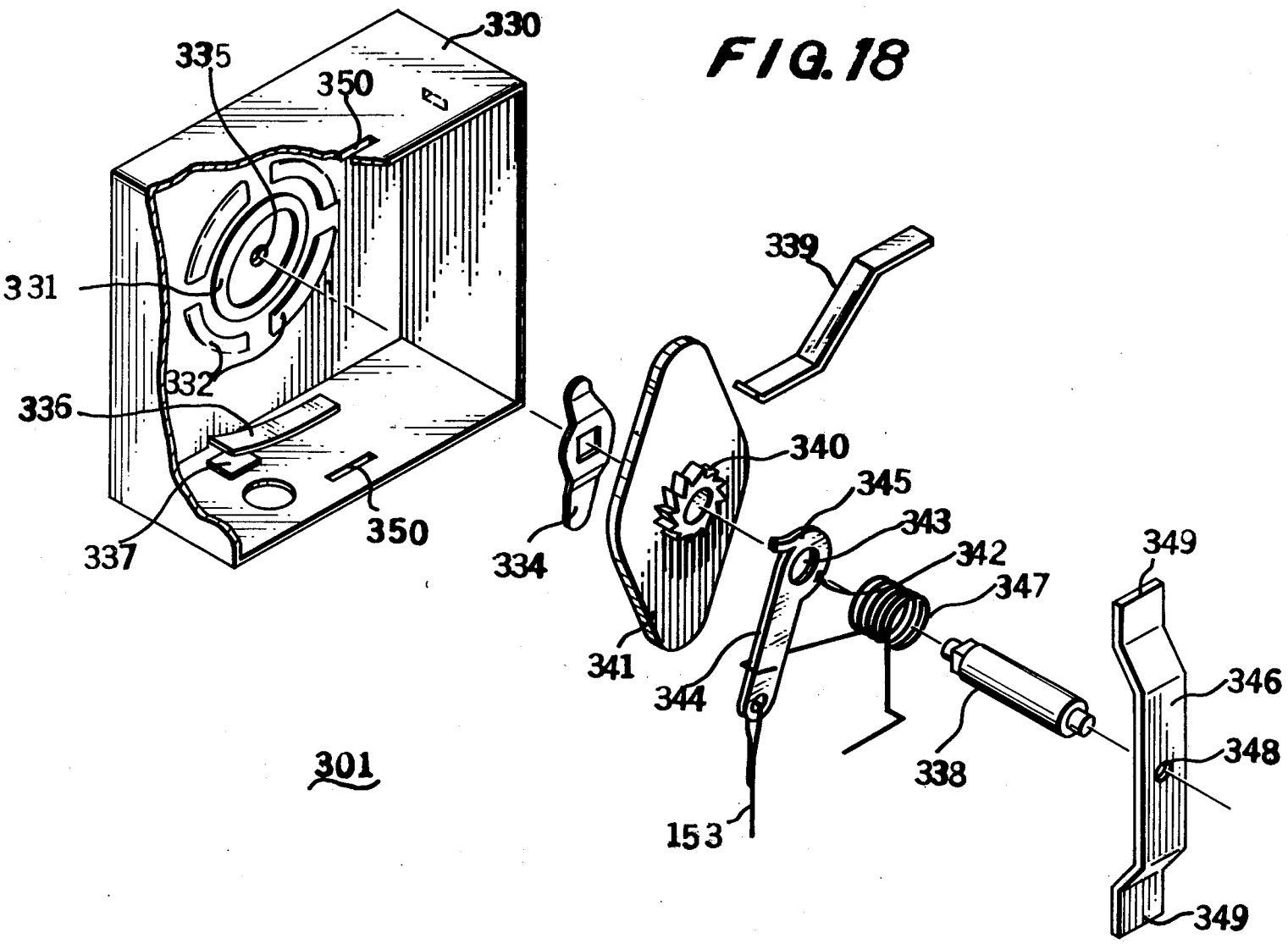
FIG. 18 is a perspective view of another controlling device in a disassembled condition, for controlling the turn on and off of a lamp of a ceiling fan according to the present invention and the rotation speed of a motor of the fan.

Referring to FIGS. 18 and 19, there is shown an example of such a controlling device 301 for the ceiling fan 300.

In the drawing, a controlling device 301 comprises a stationary contact 331 comprising an electric conductor positioned in a control box 330, a plurality of sets of contacts including two contacts 332 connected by an electric conductor 333, and a movable contact piece 334 for the speed control. Also a rotatable shaft 338, one end of is supportedly inserted into a through hole 335. An operating member 341 mounted to shaft 338 is adapted to connect or disconnect a movable contact piece 336 for turning on and off the lamp 204 in the box 330. The operating member 341 is profiled e.g. so as to have four projections, each separated by 90° and provided with spurs 340 disposed coaxially with the shaft. The spurs are adapted to engaged the end portion of a check spring 339 for preventing the reverse rotation of the shaft 338. A trigger member 345 is adapted to be operated by means of a pull string 153 and provided with pawls 342 adapted to rotate the shaft 338 is a predetermined direction through the engagement with the spurs 340 of the operating member 341, membered 344 includes a through hole 343 which allows the shaft 338 to pass therethrough. A spring 347 supported at one end by the trigger member 345 and at the other end by a supporting member 346 is adapted to set the trigger member 345 in operative position. A supporting member 346 for setting each component of the controlling device 301 in its predetermined position engages shaft 338 substantially at the center thereof with a through hole 348 through which an end of the shaft 338 is inserted and thereby rotatably secured. Two ends 349 of which supporting member 346 are adapted to be resiliently inserted into slits 350 in the control box 330. Accordingly, as shown in the electric circuit diagram in FIG. 19, electric power is supplied through the lead wire 14; the operating member 341 is rotated through the operation of the pull string 153; and a contact 353 is connected to the contact 337 when the movable contact piece 336 of a switch 352 for the lamp 204 is urged by the projection of the operating member 341, to turn on the lamp 204.

By adapting the spurs 340 and the pawl 342 so that the operating member 341 is rotated by steps of 45°, the lamp 204 is turned off by the following operation of the pull string 153. On the other hand, the movable contact piece 334 is similarly rotated stepwise interlockedly with the operating member 341, to be connected to each terminal 354, 355, 356 and 357, thereby each set of the contacts 332 being connected to the movable contact piece 334, to connect or disconnect the terminal 358 with or from each set of the said each set of contacts 332, whereby the rotation speed of the motor 7 is controlled as desired. Accordingly, in this embodiment, two pull operations of the pull string 153 allow the rotation speed to change. Further, the relative positions of the contact 332, the projections of the operating member 341, the contact 337, the movable contact piece 336 and the movable contact piece 334 are predeterminedly set. The two connections of the contact 332 may be effected, not by means of the electric conductor 333, but e.g. by integrating the two contacts by a printed circuit.

The whole or a part of the controlling device 301 is applicable to the abovementioned ceiling fan according to the present invention.

According to the ceiling fans 200, 250 and 300 of the present invention, when the stator 5 is put on a bench in assembling operation, the bent portions 26 of the member 25 serve as legs to keep the stator 5 up away from the bench, whereby the coil 4 of the motor 7 is hardly damaged, bringing a remarkable practical effect.

Further, according to the ceiling fans 200, 250 and 300 of the present invention, since an outer rotor type motor is applied, the lamp 204 and the pull switch 205 are easily mounted below the stator. And the cover 202 for the motor 7 functions to some extent as a reflecting plate for the lamp 204, increasing lighting effect.

Generally, a ceiling fan is transported with the lamp 204 and the light permeable cover 206 disassembled for the sake of preventing damage. The coil 4 in the motor 7 is enclosed by the motor cover 202 and the electric part fitting member 201 which is disposed so as to face a central opening of the motor cover 202, and thereby prevented from being damaged, and besides, the handling of the fan in transportation can be facilitated.

Further, according to the ceiling fan 300, since the pull switch for changing the rotation speed of the motor 7 is provided below the stator 5, the coil for changing the rotation speed can be set in the motor, though in case of a ceiling fan. Therefore, a lower cost of the fan is allowed in comparison with a conventional fan in which a separate choke coil or the like is connected to a motor.

A variety of embodiments and modifications of a ceiling fan according to the present invention have been described in the above, and further embodiments and modifications can be also realized, which are also included in the present invention which is defined by the appended claims.

What is claimed is:

1. A ceiling fan comprising:

a motor having a stator with a coil winding;

a vertical shaft extending through the center of said stator and having portions positioned above and below said stator;

a rotor positioned outwardly of said stator and rotatable with respect thereto;

a protecting member having an upper portion and at least one bent portion extending downwardly therefrom, said bent portion including a base;

said upper portion of said protecting member having a central opening through which said protecting member is mounted on said portion of said vertical shaft positioned below said stator, said base being located lower than said stator coil winding.

2. A ceiling fan according to claim 1 further comprising:

a cover positioned beneath said stator and said rotor, said base being positioned adjacent the inside surface of said cover and beneath said stator.

3. A ceiling fan according to claim 1 further comprising:

means for mounting a lamp beneath said stator, said means being mounted on said protecting member;

a light-transmissive cover for said lamp; and means for mounting said lamp cover.

4. A ceiling fan according to claim 3 wherein said lamp cover mounting means includes a central shaft positioned centrally on said lamp cover.

5. The ceiling fan according to claim 4 further comprising a motor cover positioned between said lamp cover and said motor, said motor cover including a central opening, said central shaft and said lamp passing through said opening.

6. A ceiling fan according to claim 4 wherein said central shaft includes an axial opening, and further comprising means for activating said lamp, including a pull string extending axially downward through said opening of said central shaft.

7. A ceiling fan according to claim 1 further comprising means for mounting a motor switch, said motor switch mounting means being mounted on said protecting member; and a motor switch for controlling the rotational speed of said motor.

8. The ceiling fan according to claim 7 further comprising a speed indicator cooperating with said switch.

* * * * *